US008970572B2

(12) United States Patent
Kim et al.

(10) Patent No.: US 8,970,572 B2
(45) Date of Patent: Mar. 3, 2015

(54) DISPLAY DEVICE AND DRIVING METHOD THEREOF

(75) Inventors: Young-Su Kim, Daegu (KR); Jae Hoon Lee, Seoul (KR); Duc-Han Cho, Incheon (KR)

(73) Assignee: Samsung Display Co., Ltd. (KR)

( * ) Notice: Subject to any disclaimer, the term of this patent is extended or adjusted under 35 U.S.C. 154(b) by 383 days.

(21) Appl. No.: 13/368,941

(22) Filed: Feb. 8, 2012

(65) Prior Publication Data

US 2013/0082996 A1 Apr. 4, 2013

(30) Foreign Application Priority Data

Sep. 29, 2011 (KR) ..... 10-2011-0099401

(51) Int. Cl.
*G09G 5/00* (2006.01)
*G09G 3/36* (2006.01)

(52) U.S. Cl.
CPC ..... *G09G 3/3677* (2013.01)
USPC ..... 345/210; 345/100; 326/80

(58) Field of Classification Search
USPC ..... 345/210
See application file for complete search history.

(56) References Cited

U.S. PATENT DOCUMENTS

| | | | | |
|---|---|---|---|---|
| 7,812,807 | B2 | 10/2010 | Yano et al. | |
| 2008/0117157 | A1* | 5/2008 | Hwang et al. | 345/92 |
| 2008/0136809 | A1 | 6/2008 | Lee et al. | |
| 2010/0220079 | A1* | 9/2010 | Bang et al. | 345/204 |
| 2011/0169723 | A1* | 7/2011 | Hsu et al. | 345/100 |
| 2011/0273430 | A1* | 11/2011 | Chia et al. | 345/212 |
| 2012/0032941 | A1* | 2/2012 | Chen et al. | 345/212 |
| 2012/0038622 | A1* | 2/2012 | Cheng et al. | 345/213 |

FOREIGN PATENT DOCUMENTS

| | | |
|---|---|---|
| JP | 09116902 | 5/1997 |
| JP | 3594589 | 9/2004 |
| JP | 2007025073 | 2/2007 |
| JP | 2008165223 | 7/2008 |
| JP | 4214562 | 11/2008 |
| JP | 2009093548 | 4/2009 |
| JP | 2010258767 | 11/2010 |
| KR | 100268904 | 7/2000 |
| KR | 1020050062116 | 6/2005 |
| KR | 1020060106408 | 10/2006 |
| KR | 1020070079643 | 8/2007 |
| KR | 1020080009984 | 1/2008 |
| KR | 1020080018648 | 2/2008 |
| KR | 1020080025502 | 3/2008 |

(Continued)

*Primary Examiner* — Lixi C Simpson
(74) *Attorney, Agent, or Firm* — Cantor Colburn LLP

(57) ABSTRACT

A driving apparatus for a display device includes: a signal controller that generates a pre-clock signal, a charge sharing control signal and a scanning start signal; a clock signal generator that generates a clock signal swinging between a first voltage and a second voltage based on the pre-clock signal and the charge sharing control signal; and a gate driver that generates gate signals based on the scanning start signal and the clock signal, where the clock signal generator includes: a voltage generator that generates a third voltage; and a clock generator that receives one of the first to third voltages in response to the pre-clock signal and the charge sharing control signal, and outputs an output signal based on the one of the first to third voltages as the clock signal, where the third voltage is lower than the first voltage and higher than the second voltage.

20 Claims, 18 Drawing Sheets

(56) References Cited

FOREIGN PATENT DOCUMENTS

| | | |
|---|---|---|
| KR | 1020080066392 | 7/2008 |
| KR | 1020090031052 | 3/2009 |
| KR | 100917324 | 9/2009 |
| KR | 100945116 | 2/2010 |
| KR | 1020100021234 | 2/2010 |
| KR | 1020110006969 | 1/2011 |

* cited by examiner

DISPLAY DEVICE AND DRIVING METHOD THEREOF

This application claims priority to Korean Patent Application No. 10-2011-0099401, filed on Sep. 29, 2011, and all the benefits accruing therefrom under U.S.C. §119, the content of which in its entirety is herein incorporated by reference.

BACKGROUND

1. Field

Provided is a display device and a driving method of the display device.

2. Description of the Related Art

A liquid crystal display ("LCD") is one of the most widely used types of flat panel display. In the LCD, the luminance difference by region due to a kickback voltage may deteriorate image quality of the LCD. The kickback voltage is substantially proportional to the height difference in a gate signal, i.e., the difference between a gate on voltage and a gate off voltage. Various efforts to improve the deterioration of the image quality caused by the kickback voltage, such as adoption of a kickback compensation circuit that generates a dual-level gate on voltage, have been made.

In addition to the image quality, low power consumption to extend the lifetime of a battery may substantially improve a mobile LCD.

A gate driving circuit for driving an LCD may be integrated on a display panel. A pulse-like clock signal having amplitude that may be substantially equal to the difference between the gate on voltage and the gate off voltage may be used for driving the above-described gate driving circuit. In such an LCD, a method of charge sharing between a high voltage side and a low voltage side during a portion of the duration of the gate on voltage has been researched to improve the deterioration of the image quality caused by the kickback voltage and to reduce the power consumption.

However, the above-described method of charge sharing may give insufficient charge sharing time due to noise, for example, and may not efficiently reduce the power consumption.

BRIEF SUMMARY

An exemplary embodiment of a driving apparatus for a display device includes: a signal controller that generates a pre-clock signal, a charge sharing control signal and a scanning start signal; a clock signal generator that generates a clock signal having a value swinging between a first voltage and a second voltage based on the pre-clock signal and the charge sharing control signal; and a gate driver that generates a plurality of gate signals to be applied to a plurality of pixels of a display panel of the display device based on the scanning start signal and the clock signal, where the clock signal generator includes: a voltage generator that generates a third voltage; and a clock generator that receives one of the third voltage from the voltage generator, the first voltage and the second voltage in response to the pre-clock signal and the charge sharing control signal, and outputs an output signal through an output terminal as the clock signal, the output signal obtained based on the one of the third voltage, the first voltage and the second voltage, where the third voltage is lower than the first voltage and higher than the second voltage, and where the value of the clock signal is changed from the first voltage to the third voltage and then from the third voltage to the second voltage, and the value of the clock signal is changed from the second voltage to the third voltage and then from the third voltage to the first voltage.

In an exemplary embodiment, the clock generator may include: a first switch connected between the first voltage and the output terminal, a second switch connected between the second voltage and the output terminal, a third switch connected between the voltage generator and the output terminal, where each of the first, second and third switches is turned on and off based on the pre-clock signal and the charge sharing control signal.

In an exemplary embodiment, each of the pre-clock signal and the charge sharing control signal may have a first value and a second value. When the pre-clock signal has the first value, the first and the third switches may be turned off and the second switch may be turned on regardless of a value of the charge sharing control signal. When the pre-clock signal has the second value and the charge sharing control signal has the first value, the first switch may be turned on and the second and the third switches may be turned off. When both the pre-clock signal and the charge sharing control signal have the second value, the first and the second switches may be turned off and the third switch may be turned off.

In an exemplary embodiment, the charge sharing control signal may rise at a time point prior to each of a rising edge and a falling edge of the pre-clock signal, and the charge sharing control signal may fall at a time point subsequent to each of a rising edge and a falling edge of the pre-clock signal.

In an exemplary embodiment, the voltage generator may include: a plurality of input resistors connected in series, where the plurality of input resistor divides a voltage from a voltage source and outputs the divided voltage; an operational amplifier including a positive terminal connected to the output of the input resistors, a negative terminal and an output terminal feedback connected to the negative terminal; and a capacitor connected to the output terminal of the operational amplifier.

In an exemplary embodiment, the voltage generator may further include an output resistor connected to the output terminal of the operational amplifier in parallel with the capacitor, and the output terminal of the clock generator may be connected to the output resistor.

In an exemplary embodiment, the voltage generator may include: a capacitor connected to a voltage source; and an output resistor connected to the voltage source and an output terminal thereof in parallel with the capacitor.

In an exemplary embodiment, the voltage generator may include an output terminal connected to a ground.

An exemplary embodiment of a driving apparatus of a display device includes: a signal controller that generates first and second pre-clock signals, a first charge sharing control signal, and a scanning start signal; a clock signal generator that generates first and second clock signals having a value swinging between a first voltage and a second voltage based on the first and second pre-clock signals and the first charge sharing control signal; and a gate driver that generates a plurality of gate signals to be applied to a plurality of pixels of a display panel of the display device based on the scanning start signal and the first and second clock signals, where the clock signal generator includes: a voltage generator that generates a third voltage; a first clock generator that receives one of the third voltage from the voltage generator, the first voltage and the second voltage in response to the first pre-clock signal and the first charge sharing control signal, and outputs an output signal obtained based on the one of the third voltage from the voltage generator, the first voltage and the second voltage through an output terminal thereof as the first clock signal; and a second clock generator that receives one of the third voltage form the voltage generator, the first voltage and the second voltage in response to the second pre-clock signal and the first charge sharing control signal, and outputs an output signal obtained based on the one of the third voltage form the voltage generator, the first voltage and the second voltage through an output terminal thereof as the second clock signal. In such an embodiment, the second pre-clock signal may be phase shifted by about 180-degree with respect to the first pre-clock signal, the third voltage may be lower than the first voltage and higher than the second voltage, the value of the clock signal may be changed from the first voltage to the third voltage and then from the third voltage to the second voltage, and the value of the clock signal may be changed from the second voltage to the third voltage and then from the third voltage to the first voltage.

In an exemplary embodiment, each the first and second clock generators may include: a first switch connected between the first voltage and the output terminal; a second switch connected between the second voltage and the output terminal; and a third switch connected between the voltage generator and the output terminal, where each of the first, second and third switches are turned on and off based on the first or second pre-clock signal and the first charge sharing control signal.

In an exemplary embodiment, each of the first and second pre-clock signals and the first charge sharing control signal may have a first value and a second value. When the first or second pre-clock signal has the first value, the first and the third switches may be turned off and the second switch may be turned on regardless of a value of the first charge sharing control signal. When the first or second pre-clock signal has the second value and the first charge sharing control signal has the first value, the first switch may be turned on and the second and the third switches may be turned off. When both the first or second pre-clock signal and the first charge sharing control signal have the second value, the first and the second switches may be turned off and the third switch may be turned off.

In an exemplary embodiment, the first charge sharing control signal may rise at a time point prior to each of a rising edge and a falling edge of the first and second pre-clock signals, and the first charge sharing control signal may fall at time point subsequent to each of a rising edge and a falling edge of the first and second pre-clock signals.

In an exemplary embodiment, the voltage generator may include: a plurality of input resistors connected in series, where the plurality of input resistor divides a voltage from a voltage source and outputs the divided voltage; an operational amplifier including a positive terminal connected to the output of the input resistors, a negative terminal and an output terminal feedback connected to the negative terminal; and a capacitor connected to the output terminal of the operational amplifier.

In an exemplary embodiment, the voltage generator may further include an output resistor connected to the output terminal of the operational amplifier in parallel with the capacitor, and the output terminal of each of the first and second clock generators may be connected to the output resistor.

In an exemplary embodiment, the voltage generator may include: a capacitor connected to a voltage source; and an output resistor connected to the voltage source and an output terminal thereof in parallel with the capacitor.

In an exemplary embodiment, the voltage generator may include an output terminal connected to a ground.

In an exemplary embodiment, the gate driver may be disposed on the display panel and may include a plurality of thin films.

In an exemplary embodiment, the signal controller and the clock signal generator may be disposed in an outside of the display panel.

In an exemplary embodiment, the signal controller and the clock signal generator may be implemented in a chip disposed on the display panel.

In an exemplary embodiment, the signal controller may further generate at least one additional pair of pre-clock signals and at least one additional charge sharing control signal, the clock signal generator may further include at least one additional pair of clock generators, each of the at least one additional pair of clock generators may generate one of at least one additional pair of clock signals based on one of the at least one additional pair of pre-clock signals and the at least one additional charge sharing control signal, each of the at least one additional pair of clock signals may have a value swinging between the first voltage and the second voltage, the value of each of the at least one additional pair of clock signals may be changed from the first voltage to the third voltage and then from the third voltage to the second voltage, and the value of each of the at least one additional pair of clock signals may be changed from the second voltage to the third voltage and then from the third voltage to the first voltage, and the gate driver may generate the gate signals based on the at least one additional pair of clock signals.

BRIEF DESCRIPTION OF THE DRAWINGS

The above and other aspects and features will become more apparent by describing in further detail exemplary embodiments thereof with reference to the accompanying drawings, in which.

DETAILED DESCRIPTION

Figure 1:
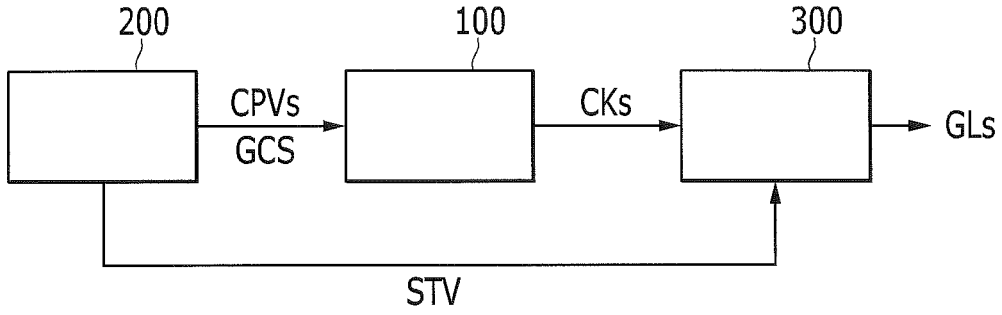
FIG. 1 is a block diagram showing an exemplary embodiment of a driving apparatus for a display device.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of the invention will be described in detail with reference to the accompanying drawings.

An exemplary embodiment of a driving apparatus for a display device will now be described in detail with reference to FIGS. 1 to 7.

Figure 2:
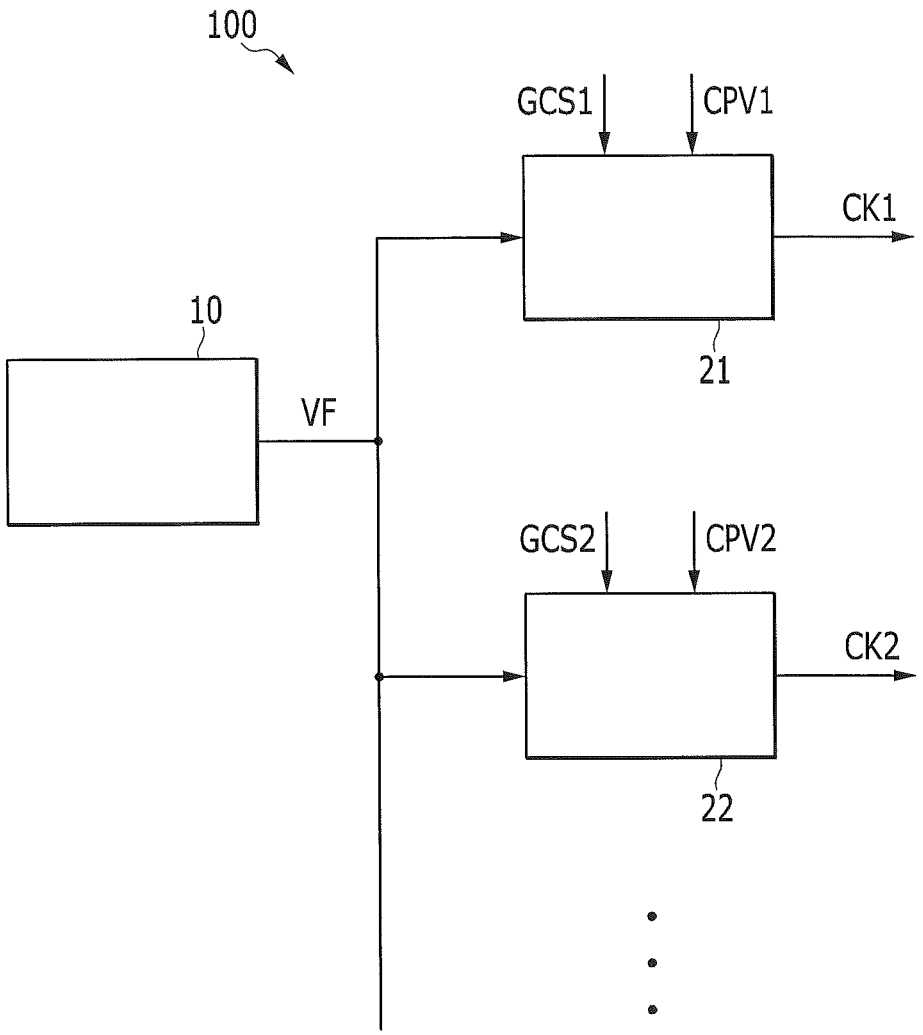
FIG. 2 is a block diagram showing an exemplary embodiment of a clock signal generator.
Figure 3:
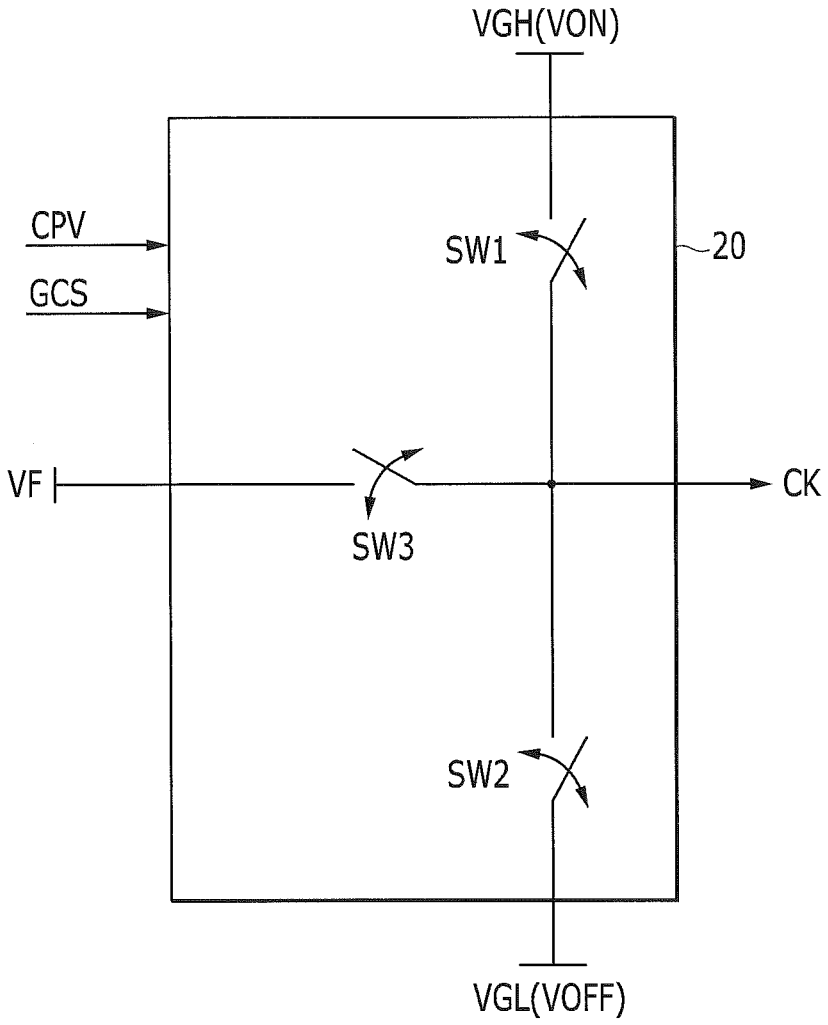
FIG. 3 is a block diagram showing an exemplary embodiment of a clock generator.
Figure 4:
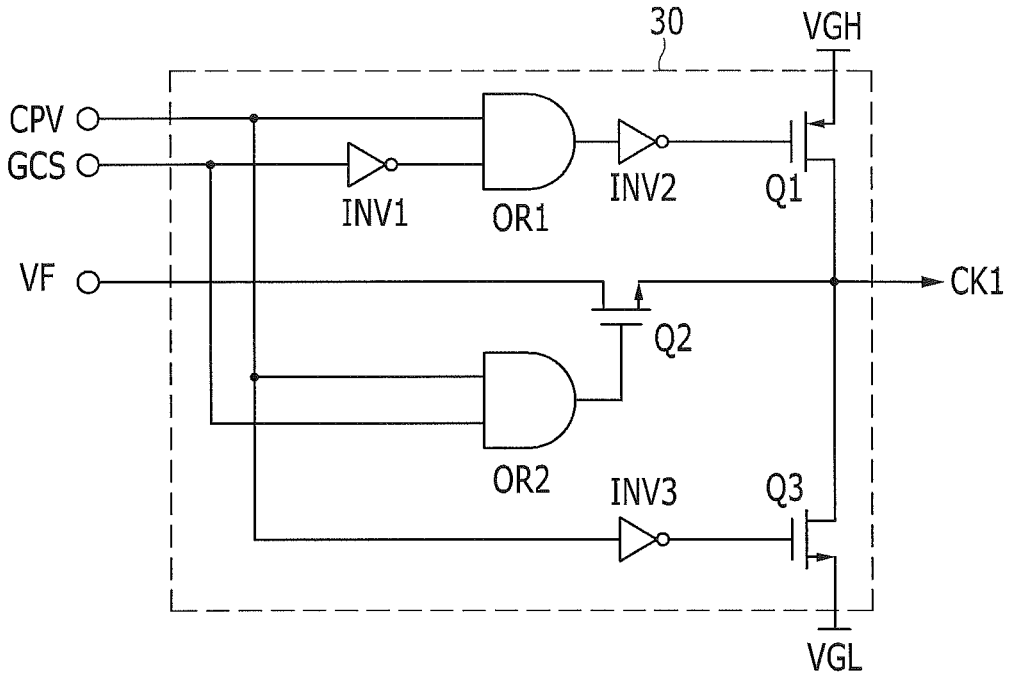
FIG. 4 is a schematic circuit diagram showing an exemplary embodiment of the clock generator shown in FIG. 3.

FIG. 1 is a block diagram showing an exemplary embodiment of a driving apparatus for a display device, FIG. 2 is a block diagram showing an exemplary embodiment of a clock signal generator, FIG. 3 is a block diagram showing an exemplary embodiment of a clock generator, FIG. 4 is a schematic circuit diagram showing an exemplary embodiment of the clock generator shown in FIG. 3, and FIGS. 5 to 7 are schematic circuit diagrams showing exemplary embodiments of a voltage generator.

Referring to FIG. 1, an exemplary embodiment of a driving apparatus for a display device includes a clock signal generator 100, a signal controller 200 and a gate driver 300.

The signal controller 200 generates various control signals for driving a display device, for example, a plurality of pre-clock signals CPVs, a charge sharing control signal GCS and a scanning start signal STV.

The clock signal generator 100 receives the pre-clock signals CPVs and the charge sharing control signal GCS from the signal controller 200, and generates and outputs a plurality of clock signals CKs. The clock signals CKs generated by the clock signal generator 100 may be a signal acquired by raising the level of the pre-clock signals CPVs and by changing raising and falling edges of the pre-clock signals CPVs into stepwise edges.

Referring now to FIG. 2, the clock signal generator 100 may include a voltage generator 10 and at least one clock generator 21 and 22.

The voltage generator 10 generates and outputs a voltage VF (also referred to as "an intermediate voltage" hereinafter).

Each of the clock generators 21 and 22 receives the output voltage from the voltage generator 10, that is, the intermediate voltage VF, receives a pre-clock signal CPV1 or CPV2, and a charge sharing control signal GCS1 or GCS2, from the signal controller 200, and generates a clock signal CK1 or CK2. In an exemplary embodiment, a pair of the pre-clock signals, e.g., a first pre-clock signal CPV1 and a second pre-clock signal CPV2 transmitted to a pair of the clock generators, e.g., a first clock generator 21 and a second clock generator 22, respectively, may have phases inversed to each other. In such an embodiment, a pair of the charge sharing control signals, e.g., a first charge sharing signal GCS1 and a second charge sharing signal GCS2 transmitted to the first and second clock generators 21 and 22, respectively, may be substantially the same. In an alternative exemplary embodiment, the first and second clock signals CK1 and CK2 generated by the first and second clock generators 21 and 22, respectively, may be independent of each other. In an exemplary embodiment, the number of the clock generators may be greater than or equal to one. In another exemplary embodiment, the number of the clock generators may be an even number equal to or greater than two, where the clock generators form pairs.

Referring now to FIG. 3, an exemplary embodiment of a clock generator 20 may include first to third switches SW1, SW2 and SW3. The first switch SW1 is connected between a high voltage VGH and an output terminal of the clock generator 20, the second switch SW2 is connected between a low voltage VGL and the output terminal of the clock generator 20, and the third switch SW3 is connected between the intermediate voltage VF and the output terminal of the clock generator 20. The first to the third switches SW1, SW2 and SW3 are controlled, e.g., turned on and off, based on a pre-clock signal CPV and a charge sharing control signal GCS, and the clock generator 20 selects and outputs one of the high voltage VGH, the low voltage VGL and the intermediate voltage VF as a clock signal CK. The clock signal CK changes via the intermediate voltage VF when the clock signal CK changes from the high voltage VGH to the low voltage VGL, or when the clock signal CK changes from the low voltage VGL to the high voltage VGH.

A structure of an exemplary embodiment of the clock generator 20 is shown in FIG. 4, but the invention is not limited thereto.

In an alternative exemplary embodiment, as shown in FIG. 4, a clock generator 30 includes a plurality of logic gates OR1, OR2, INV1, INV2 and INV3 and three field effect transistors ("FET"s) Q1, Q2 and Q3, for example, metal-oxide-silicon FETs ("MOSFET"s). The transistors Q1, Q2 and Q3 correspond to the switches SW1, SW2 and SW3 shown in FIG. 3, respectively. The logic gates OR1, OR2, INV1, INV2 and INV3 include first and second OR gates OR1 and OR2 and first to third NOT gates INV1, INV2 and INV3. The logic gates OR1, OR2, INV1, INV2 and INV3 control the turning on and off of the transistors Q1, Q2 and Q3 in response to the pre-clock signal CPV and the charge sharing control signal GCS.

The first transistor Q1 may be, for example, a p-channel MOSFET and has a gate connected to an output of the second NOT gate INV2, a source connected to a gate high voltage VGH, and a drain connected to the output terminal of the clock generator 30.

An input of the second NOT gate INV2 is an output of the first OR gate OR1. A first input of the first OR gate OR1 is the pre-clock signal CPV, and a second input of the first OR gate OR1 is an inverse of the charge sharing control signal GCS that have passed through the first NOT gate INV1.

The second transistor Q2 may be, for example, an n-channel MOSFET and has a gate connected to an output of the second OR gate OR2, a source connected to the output of the clock generator 30, and a drain connected to an output of the voltage generator 10. A first input of the second OR gate OR2 is the pre-clock signal CPV, and a second input of the second OR gate OR2 is the charge sharing control signal GCS.

The third transistor Q3 may be, for example, an n-channel MOSFET and has a gate connected to an output of the third NOT gate INV3, a source connected to the low voltage VGL, and a drain connected to the output terminal of the clock generator 30. An input of the third NOT gate INV3 is the pre-clock signal CPV.

The voltage generator 10 may also be embodied into various structures, and exemplary embodiments of the voltage generator 10 will be described referring to FIGS. 5 to 7.

Figure 5:
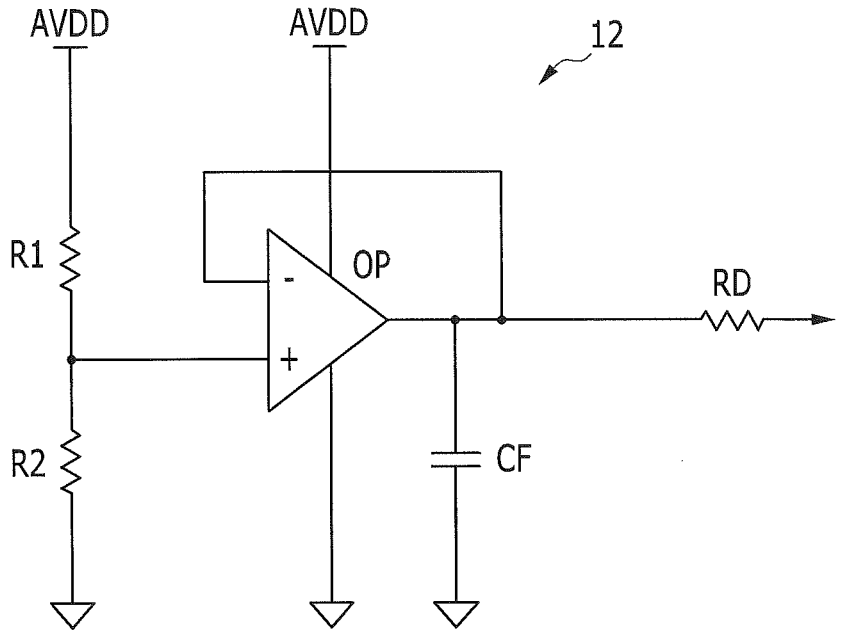
FIGS. 5 to 7 are schematic circuit diagram showing exemplary embodiments of a voltage generator.

In an exemplary embodiment, as shown in FIG. 5, a voltage generator 12 includes a plurality of divisional resistors, e.g., two resistors R1 and R2, an operational amplifier OP, a capacitor CF and an output resistor RD.

The divisional resistors R1 and R2 are connected in series to a voltage source AVDD. The divisional resistors R1 and R2 divide the voltage of the voltage source AVDD and provide the divided voltage to a positive terminal (+) of the operational amplifier OP. The operational amplifier OP is biased with the voltage source AVDD, and has an output terminal connected to the output resistor RD and a negative terminal (−) feedback connected to the output terminal, thereby stably outputting the voltage from the divisional resistors R1 and R2. The capacitor CF is connected to the output terminal of the operational amplifier OP in parallel with the output resistor RD, and the capacitor CF stores external electric charges and outputs the stored charges, thereby causing the voltage generator 10 to maintain stable output. In an exemplary embodiment, the magnitude of the output voltage of the voltage generator 10 may be controlled by adjusting the resistances of the resistors R1 and R2. In an exemplary embodiment, moving speed of the electric charges stored in the capacitor CF may be controlled by adjusting the resistance of the output resistor RD. In an alternative exemplary embodiment, the output resistor RD may be omitted.

Figure 6:
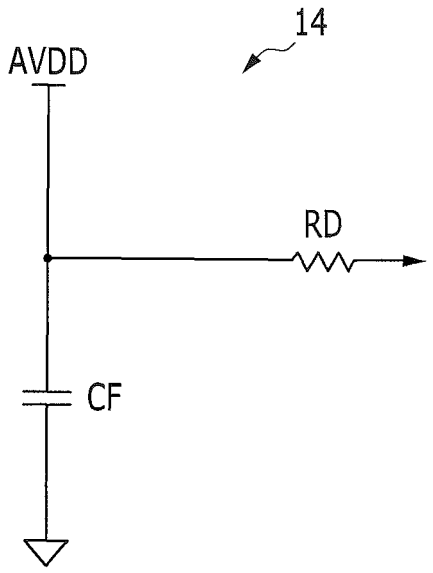

In an alternative exemplary embodiment, as shown in FIG. 6, a voltage generator 14 includes a capacitor CF and an output resistor RD that are connected in parallel to an external voltage source AVDD.

Figure 7:
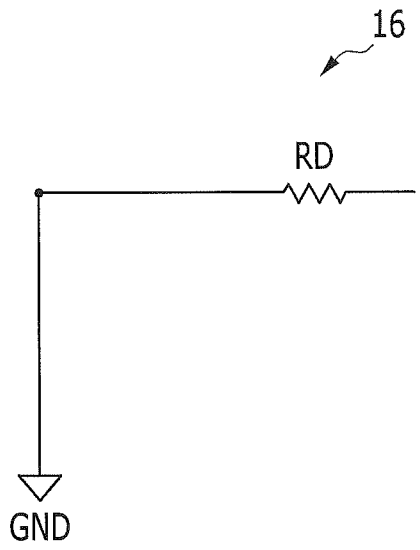

In another alternative exemplary embodiment, as shown in FIG. 7, a voltage generator 16 includes an output resistor RD connected to a ground GND.

Referring again to FIG. 1, the gate driver 300 receives the scanning start signal STV from the signal controller 200 and the clock signals CKs from the clock signal generator 100, and the gate driver 300 generates and applies a plurality of gate signals to a plurality of gate lines GLs of a display panel (not shown). A plurality of pixels (not shown) connected to the gate lines GLs display images in response to the gate signals applied to the gate lines GLs.

Each of the gate signals may be a combination of the high voltage VGH and the low voltage VGL, and the duration of the high voltage VGH may be shorter than the duration of the low voltage VGL. Each of the pixels may include a switching element (not shown) such as an FET. In such an embodiment, the high voltage VGH may be substantially the same as a gate on voltage VON for turning on the switching element, and the low voltage VGL may be substantially the same as a gate off voltage VOFF for turning off the switching element. When the switching element is turned on, a data voltage corresponding to an image to be displayed by a pixel may be applied to the pixel. When the switching element is turned off, the data voltage applied to the pixel may be maintained.

Hereinafter, an exemplary embodiment of a clock signal generator and an operation thereof will be described in detail with reference to FIGS. 8 to 13.

Figure 8:
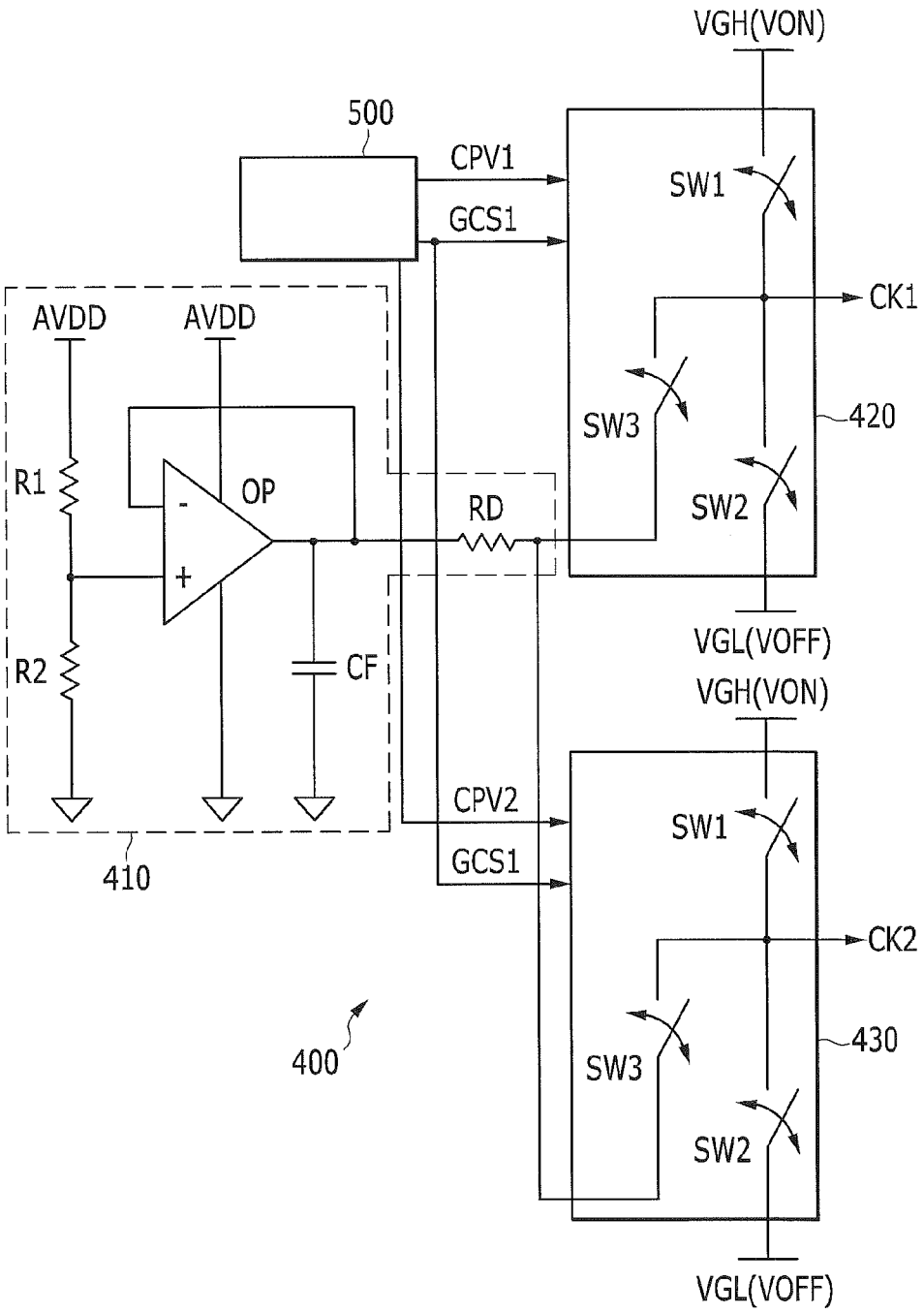
FIG. 8 is a schematic circuit diagram showing a clock signal generator and a signal controller of an exemplary embodiment of a driving apparatus.
Figure 9:
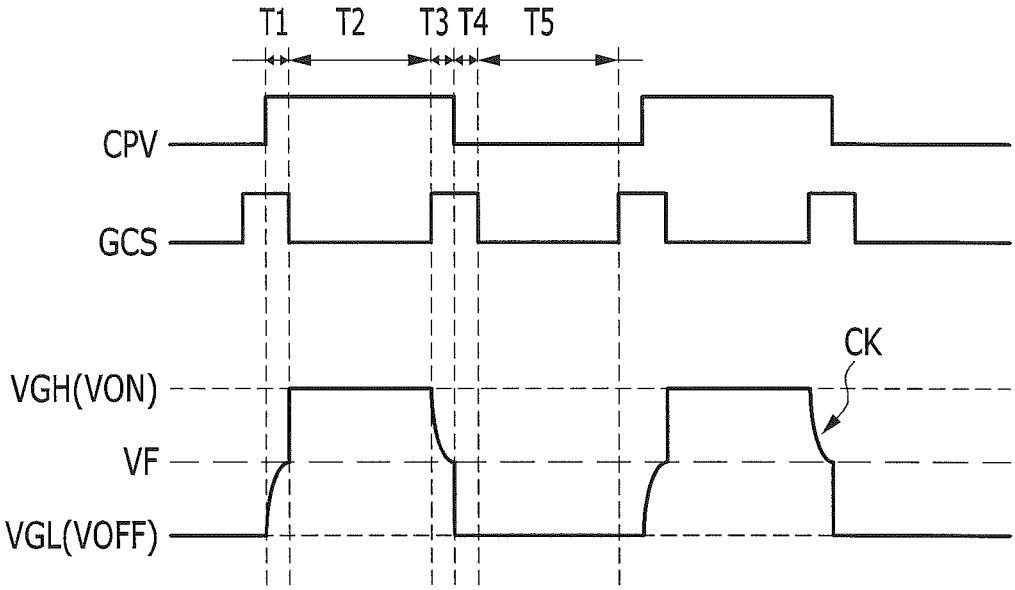
FIG. 9 is a signal timing diagram showing signals of an exemplary embodiment of a level shifter.
Figure 10:
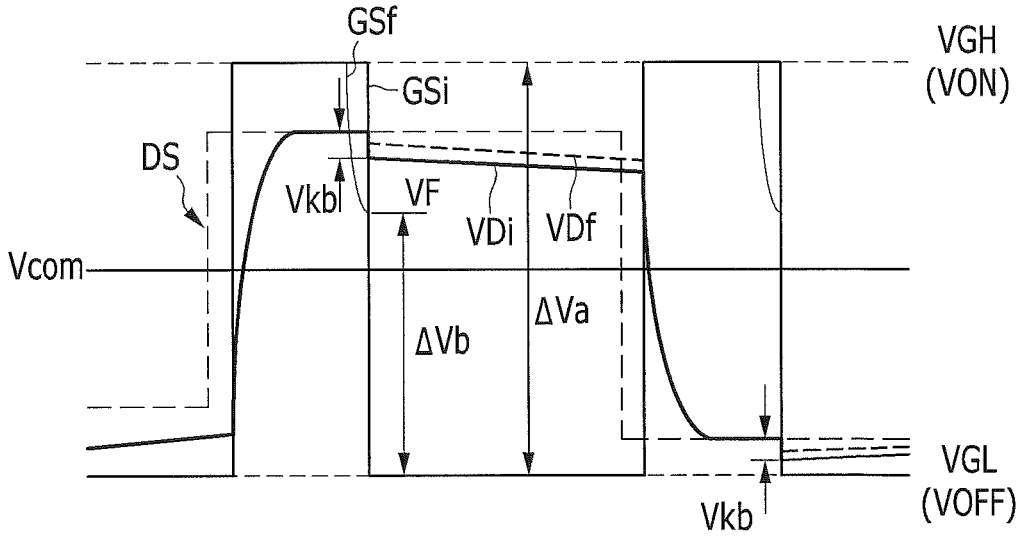
FIG. 10 is a signal timing diagram showing kickback voltage reduction in a gate signal of an exemplary embodiment of a driving apparatus.
Figure 11:
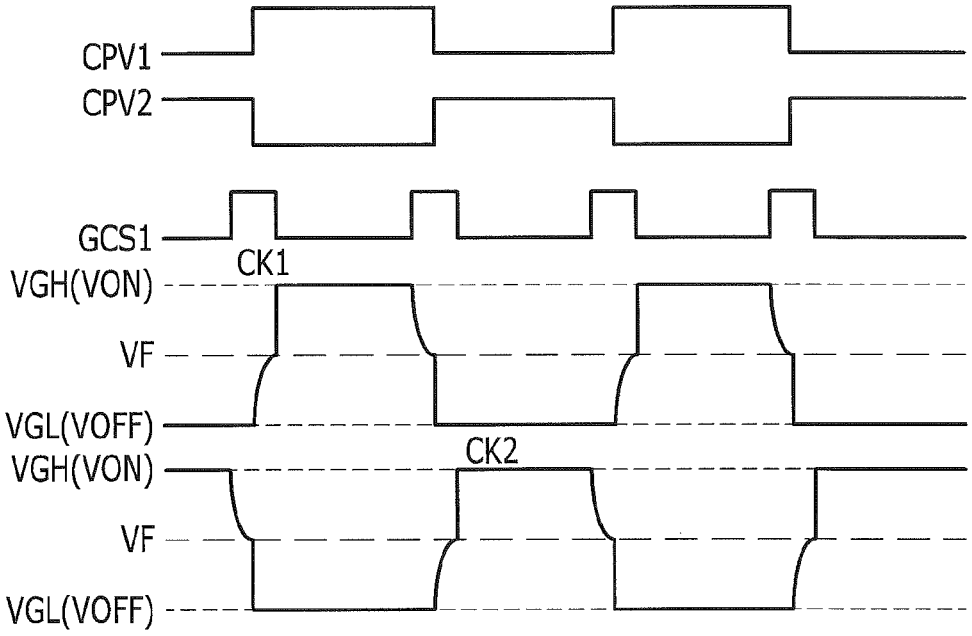
FIGS. 11 to 13 are signal timing diagrams showing signals of exemplary embodiments of a clock signal generator.
Figure 12:
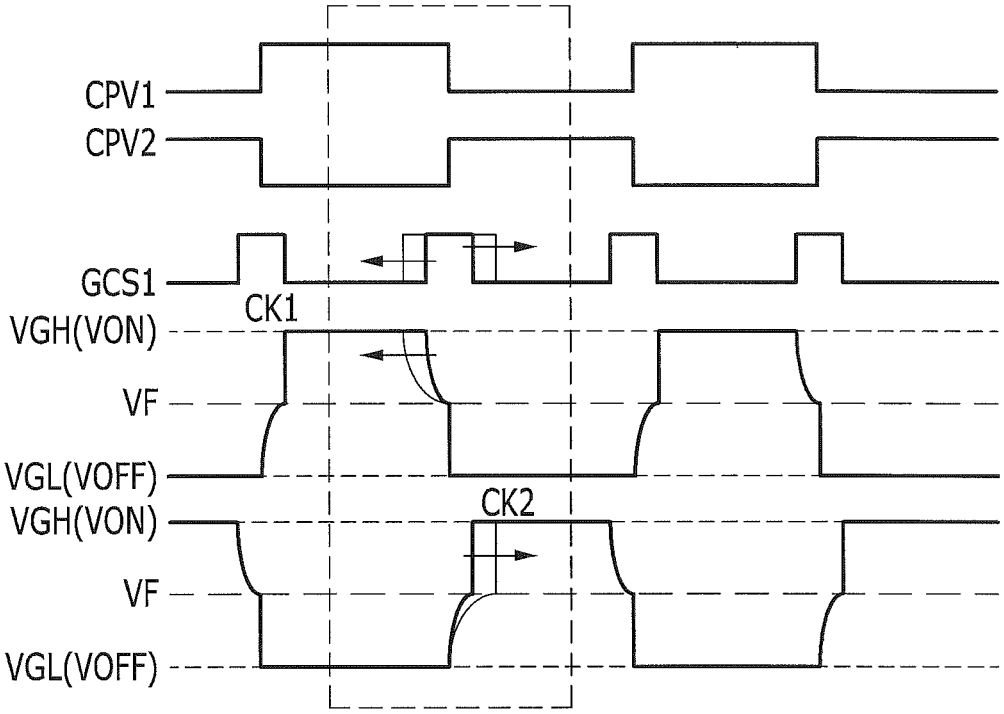
Figure 13:
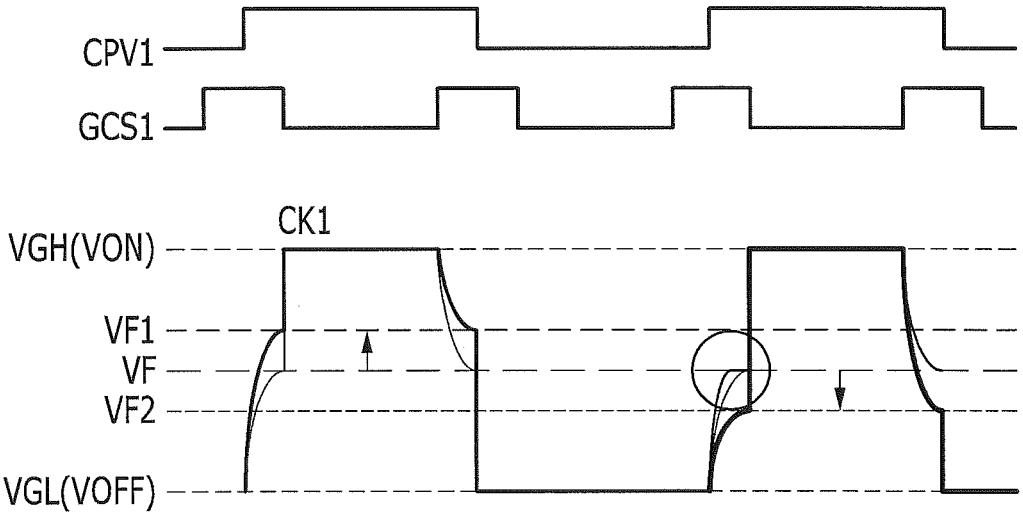

FIG. 8 is a schematic circuit diagram showing a clock signal generator and a signal controller of an exemplary embodiment of a driving apparatus, FIG. 9 is a signal timing diagram showing signals of an exemplary embodiment of a level shifter, FIG. 10 is a signal timing diagram showing kickback voltage reduction in a gate signal of an exemplary embodiment of a driving apparatus, and FIGS. 11 to 13 are signal timing diagrams showing signals of exemplary embodiments of a clock signal generator.

Referring to FIG. 8, an exemplary embodiment of a clock signal generator 400 includes a voltage generator 410, a first level shifter 420 and a second level shifter 430.

The voltage generator 410 includes a plurality of divisional resistors, e.g., two divisional resistors R1 and R2, an operational amplifier OP, a capacitor CF and an output resistor RD. The voltage generator 410 show in FIG. 8 may be substantially the same as the voltage generator 12 shown in FIG. 5, and any repetitive detailed description thereof will hereinafter be omitted.

Each of the first and second level shifters 420 and 430 includes first to third switches SW1, SW2 and SW3, and outputs a clock signal, e.g., a first clock signal CK1 or a second clock signal CK2. The first and the second level shifters 420 and 430 may have substantially the same structure as the clock generator 20 shown in FIG. 3, and any repetitive detailed description thereof will hereinafter be omitted. In such an embodiment, the term "level shifter" is used instead of the term "clock generator" since the first and second level shifters 420 and 403 change the voltage levels of pre-clock signals CPV1 and CPV2.

A signal controller 500 generates first and second pre-clock signals CPV1 and CPV2 and a charge sharing control signal GCS1, and outputs the first pre-clock signal CPV1 and the charge sharing control signal GCS1 to the first level shifter 420, and the second pre-clock signal CPV2 and the charge sharing control signal GCS1 to the second level shifter 430. The first pre-clock signal CPV1 and the second pre-clock signal CPV2 may be inversed or 180-degree phase shifted with respect to each other.

Now, an operation of the level shifter is described in detail with reference to FIG. 9. Since the first and second level shifters 420 and 430 operate substantially in the same manner, the operation of only one of the two level shifters will be described for descriptive convenience. In FIG. 9, a pre-clock signal and a charge sharing control signal inputted to the level shifter are denoted by CPV and GCS, respectively, and a clock signal is denoted by CK.

The turning on and off of the first to third switches SW1, SW2 and SW3 of the level shifter 420 or 430 is determined by a combination of the magnitudes of the pre-clock signal CPV and the charge sharing control signal GCS that repeat a first value (low voltage) and a second value (high voltage) as shown in Table 1.

TABLE 1

| CPV | GCS | SW1 | SW2 | SW3 |
|---|---|---|---|---|
| 0 (low) | 0 (low) | off | on | off |
| 0 (low) | 1 (high) | off | on | off |
| 1 (high) | 0 (low) | on | off | off |
| 1 (high) | 1 (high) | off | off | on |

Here, "off" denotes a state where the switch is turned off such that the current does not flow, and "on" denotes a state where the switch is turned on to make current flow.

In an exemplary embodiment, each of the pre-clock signal CPV and the charge sharing control signal GCS may have one of the first value, e.g., 0, and the second value, e.g., 1. Hereinafter, the first value may be referred to as a low value, and the second value may be referred to as a high value.

Referring to FIG. 9, the pre-clock signal CPV and the charge sharing control signal GCS have the high value, e.g., 1, in a first period T1, and the first and the second switches SW1 and SW2 are turned off, while the third switch SW3 is turned on. In the first period T1, the output of the level shifter 420 or 430 is disconnected from the high voltage VGH and the low voltage VGL, and the output of the level shifter 420 or 430 is connected to the voltage generator 410, thereby being in a charge sharing state. Accordingly, the clock signal CK becomes the intermediate voltage VF, that is, the output voltage of the voltage generator 410. As shown in FIG. 9, when a previous voltage of the clock signal CK is the low voltage VGL, the clock signal CK rises to the intermediate voltage VF higher than the low voltage VGL as shown in a curve of FIG. 9.

At the beginning of a second period T2, the pre-clock signal CPV has the high value, and the charge sharing control signal GCS changes from the high value to the low value. In the second period T2, the first switch SW1 is turned on, the second switch SW2 is maintained as turned off, and the third switch SW3 is turned off. Accordingly, the output of the level shifter 420 or 430 is connected to the high voltage VGH such that the clock signal CK becomes the high voltage VGH.

In the second period T2, since the clock signal CK rises from the intermediate voltage VF to the high voltage VGH during a substantially short time period, the waveform of the clock signal CK at the beginning of the second period T2 is substantially vertical as shown in FIG. 9, which is different from the waveform of the clock signal CK at the charge sharing stage in the first period T1. The voltage change in the charge sharing stage is substantially slow due to the connection of the output terminal of the level shifter 420 or 430 to the voltage generator 410 that includes internal circuits such as the operational amplifier OP and the capacitor CF, instead of direct connection to an external source in the charge sharing stage, and thus it takes time for the electric charges stored in the capacitor CF of the voltage generator 410 to be discharged to the output terminal of the clock signal generator 400 through the resistor RD.

In a third period T3, the charge sharing control signal GCS changes from the low value to the high value while the pre-clock signal CPV is maintained to have the high value. In the third period T3, as in the first period T1, the first and the second switches SW1 and SW2 are turned off, and the third switch SW3 is turned on such that the output of the level shifter 420 or 430 is connected to the voltage generator 410 thereby being in a charge sharing state. Accordingly, the clock signal CK falls to the intermediate voltage VF as shown in a curve of FIG. 9.

In a fourth period T4, the pre-clock signal CPV changes from the high value to the low value, while the charge sharing control signal GCS is maintained to have the high value. In the fourth period T4, the first switch SW1 is maintained as turned off, the second switch SW2 is turned on, and the third switch SW3 is turned off. Accordingly, the output of the level shifter 420 or 430 is connected to the low voltage VGL such that the clock signal CK changes from the intermediate voltage VF to the low voltage VGL during a substantially short time period, thereby forming substantially a vertical line as shown in FIG. 9.

In a fifth period T5, the pre-clock signal CPV changes from the high value to the low value, while the charge sharing control signal GCS is maintained to have the low value, and thus both of the per-clock signal and the charge sharing control signal CPV and GCS have the low value. In the fifth period T5, the first and the third switches SW1 and SW3 are turned off, and the second switch SW2 is maintained as turned on, as in the fourth period T4, such that the clock signal CK is maintained in the low voltage VGL.

As described above with reference to FIG. 1, the clock signal CK is inputted to the gate driver 300 which generates the gate signals based thereon. Referring now to FIG. 10, since the rising and falling edges of the clock signal CK have curved shapes, a gate signal may also include a curved shape. In one exemplary embodiment, for example, a gate signal of an exemplary embodiment of a driving apparatus denoted as GSf in FIG. 10 may fall from a gate on voltage VON to the intermediate voltage VF with forming a curve, and then may further fall to a gate off voltage VOFF with forming substantially a vertical line. When the gate signal GSf rise from the gate off voltage VOFF to the gate on voltage VON, the gate signal GSf is shown in FIG. 10 to have a waveform in a substantially vertically straight line for convenience of description although the gate signal GSf may rise to the intermediate voltage VF with forming a waveform similar to the clock signal CK shown in FIG. 9. In FIG. 10, GSi denotes a gate signal in a case where the clock signal has a square waveform, which is different from a gate signal of an exemplary embodiment of a driving apparatus for comparison.

In an exemplary embodiment, the display apparatus may be included in an liquid crystal display ("LCD"), for example, and a data signal DS is applied to a data line connected to a pixel in a display panel (not shown), the voltage of the data signal DS is charged into the pixel when the gate signal reaches the gate on voltage VON. When the gate signal substantially rapidly drops from the gate on voltage VON to the gate off voltage VOFF, the voltage of the pixel may drop slightly due to the parasitic capacitance between a gate and a source or between the gate and a drain of a transistor, that is, a switching element of the pixel. The voltage drop of the pixel when the gate signal suddenly drops from the gate on voltage VON to the gate off voltage VOFF may be referred to as "kickback voltage."

The magnitude of the kickback voltage is substantially proportional to the voltage change of the gate signal. The gate signal GSi having square waveform drops substantially rapidly from the gate on voltage VON to the gate off voltage VOFF, and thus the voltage drop ΔVa may satisfy the following equation: ΔVa=VON−VOFF. However, in the gate signal GSf of an exemplary embodiment of a driving apparatus, the curved voltage drop from the gate on voltage VON to the intermediate voltage VF may not contribute to the kickback voltage, and the rapid voltage drop from the intermediate voltage VF to the gate off voltage VOFF may contribute to the kickback voltage. In an exemplary embodiment, the voltage drop ΔVb satisfies the following equation: ΔVb=VF−VOFF, and the voltage drop ΔVb is thereby substantially smaller than the voltage drop ΔVa for the gate signal GSi having square waveform such that the kickback voltage may be reduced. In FIG. 10, VDi denotes the pixel voltage for the gate signal GSi having square waveform, and VDf denotes the pixel voltage for the gate signal GSf of an exemplary embodiment of a driving apparatus.

The power consumption per gate signal is substantially proportional to the square of the difference between a high voltage and a low voltage of the gate signal. Although the voltage difference for the gate signal GSi having square waveform is ΔVa (=VON−VOFF), the voltage difference in such an embodiment is ΔVb (=VF−VOFF) that is smaller than ΔVa such that the power consumption is substantially reduced.

As described above with reference to FIG. 2, the first and the second level shifters 420 and 430 may respectively receive the first and second pre-clock signals CPV1 and CPV2, inversed with respect to each other, the waveforms of which are shown in FIG. 11.

Referring to FIG. 11, the second level shifter 430 may receive the second pre-clock signal CPV2 inversed with respect to the first pre-clock signal CPV1 instead of receiving the first pre-clock signal CPV1. In such an embodiment, a first clock signal CK1 outputted from the first level shifter 420 may be about 180-degree phase shifted signal with respect to a second clock signal CK2 outputted from the second level shifter 430.

In an exemplary embodiment, as shown in FIG. 11, a voltage changing period of the first clock signal CK1 is adjacent to but not overlapping a voltage changing period of the second clock signal CK2. In such an embodiment, the voltage rise of the second clock signal CK2 begins immediately after the voltage drop of the first clock signal CK1 is finished, and the voltage of the first clock signal CK1 begins to rise immediately after the voltage drop of the second clock signal CK2 is finished.

In an alternative exemplary embodiment, the voltage changing periods of the first clock signal CK1 and the second clock signal CK2 may overlap each other. In one exemplary embodiment, for example, the first clock signal CK1 and the second clock signal CK2 that have reversed high and low states may be connected to each other for a charge sharing of the first and second clock signals CK1 and CK2, thereby changing the voltage levels of the first and second clock signals CK1 and CK2 simultaneously. In such an embodiment, the intermediate voltage VF is separately generated and the voltage rise and drop progress via the intermediate voltage VF. However, in such an embodiment where the first and second clock signals CK1 and CK2 are simultaneously varied, noise may increase as the duration of the voltage change increases such that an error in operation may occur.

In an exemplary embodiment where the voltage changing period of the first clock signal CK1 is adjacent to but not overlapping the voltage changing period of the second clock signal CK2, a noise may be effectively prevented, and thus the duration of the voltage change for reducing power consumption may be substantially elongated.

An exemplary experiment on an exemplary embodiment of a circuit manufactured was performed. The exemplary experiment showed that the power consumption of a gate driver and a module decreased by about 31.7% and about 11.2%, respectively, as compared with power consumption of a comparative example of a gate driver and a module using a gate signal having square waveform.

In an exemplary embodiment, a slope of the waveform of the clock signal CK1 or CK2 at rising or falling edges may be decreased as shown in FIG. 12 to elongate the voltage changing period, and the decreased slope may be obtained by changing the rising time or the falling time of the charge sharing control signal GCS1. In one exemplary embodiment, for example, when the first or the second pre-clock signal CPV1 or CPV2 has the high value (or high voltage) and the charge sharing control signal GCS1 has the low value (or the low voltage), advancing the rising time of the charge sharing control signal GCS1 may decrease the slope of the waveform of the first or the second clock signal CK1 or CK2 falling from the high voltage VGH to the intermediate voltage VF. In such an embodiment, when the first or the second pre-clock signal CPV1 or CPV2 has the low value and the charge sharing control signal GCS1 has the high value, delaying the falling time of the charge sharing control signal GCS1 may decrease the slope of the waveform of the first or the second clock signal CK1 or CK2 rising from the low voltage VGL to the intermediate voltage VF.

In an exemplary embodiment, the output voltage of the voltage generator 410 may be controlled by adjusting the resistances of the divisional resistors R1 and R2 in the voltage generator 410, and the moving speed of the electric charges stored in the capacitor CF may be controlled by adjusting the resistance of the output resistor RD. Referring to FIG. 13, for example, the output voltage of the voltage generator 10 may rise from VF to VF1 by increasing R1/R2, and the output voltage of the voltage generator 10 may drop from VF to VF2 by decreasing R1/R2. In such an embodiment, when the resistance of the output resistor RD is decreased, as denoted by a circle in FIG. 13, the slope of the voltage rise may increase such that the voltage may be changed to the intermediate voltage VF substantially rapidly.

Exemplary embodiments of a driving apparatus for a display device including the clock signal generator will hereinafter be described in detail with reference to FIGS. 14 to 18.

Figure 14:
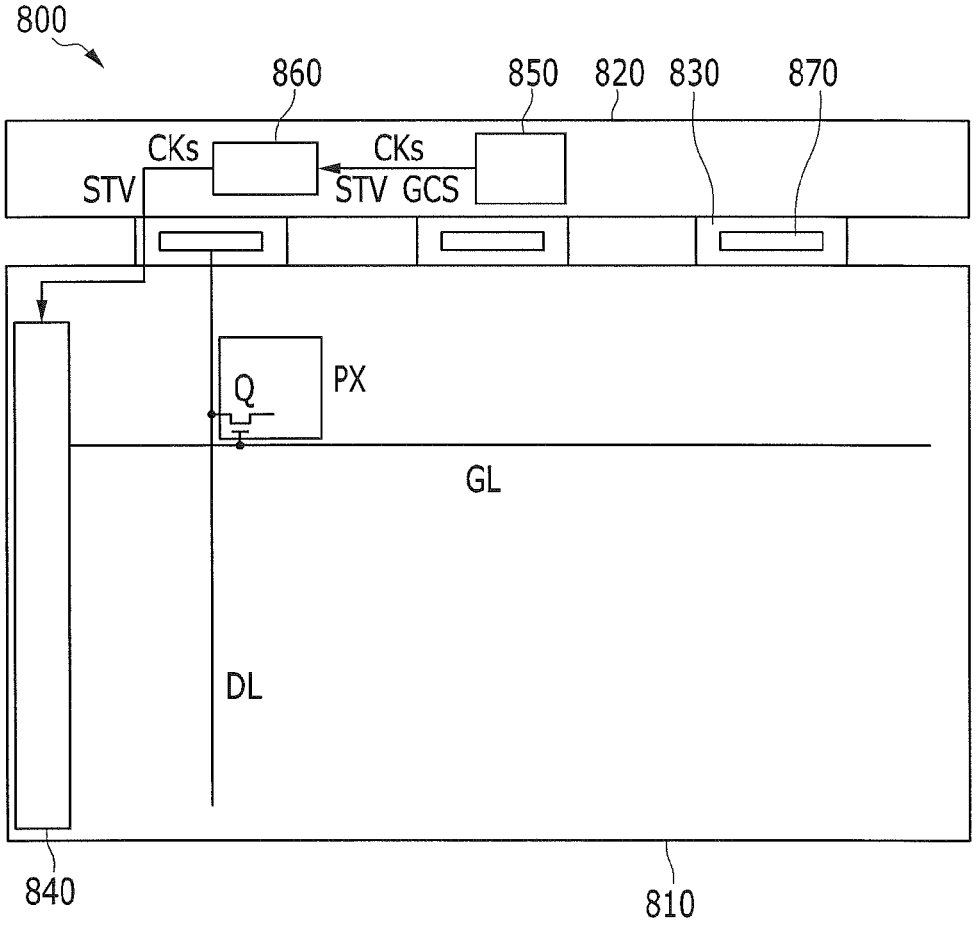
FIGS. 14 and 15 are block diagrams showing exemplary embodiments of a display device including a driving apparatus.
Figure 15:
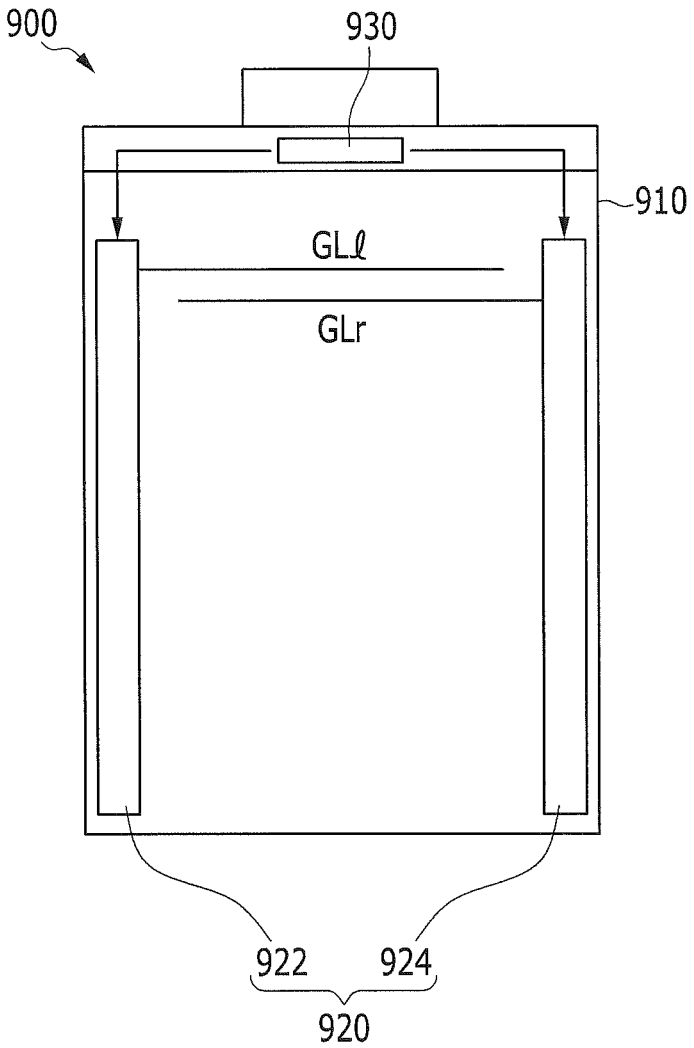
Figure 16:
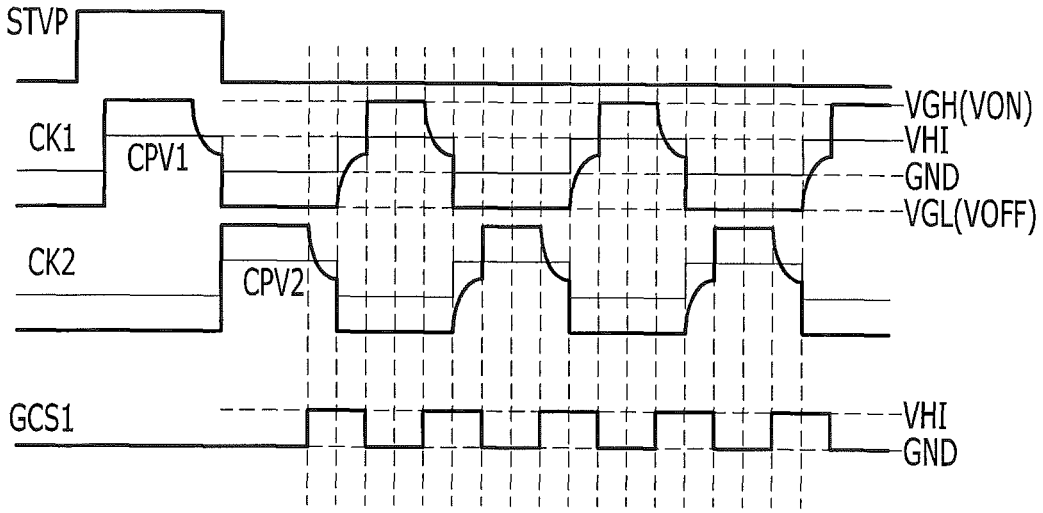
FIGS. 16 to 18 are signal timing diagrams showing signals of exemplary embodiments of a display device.
Figure 17:
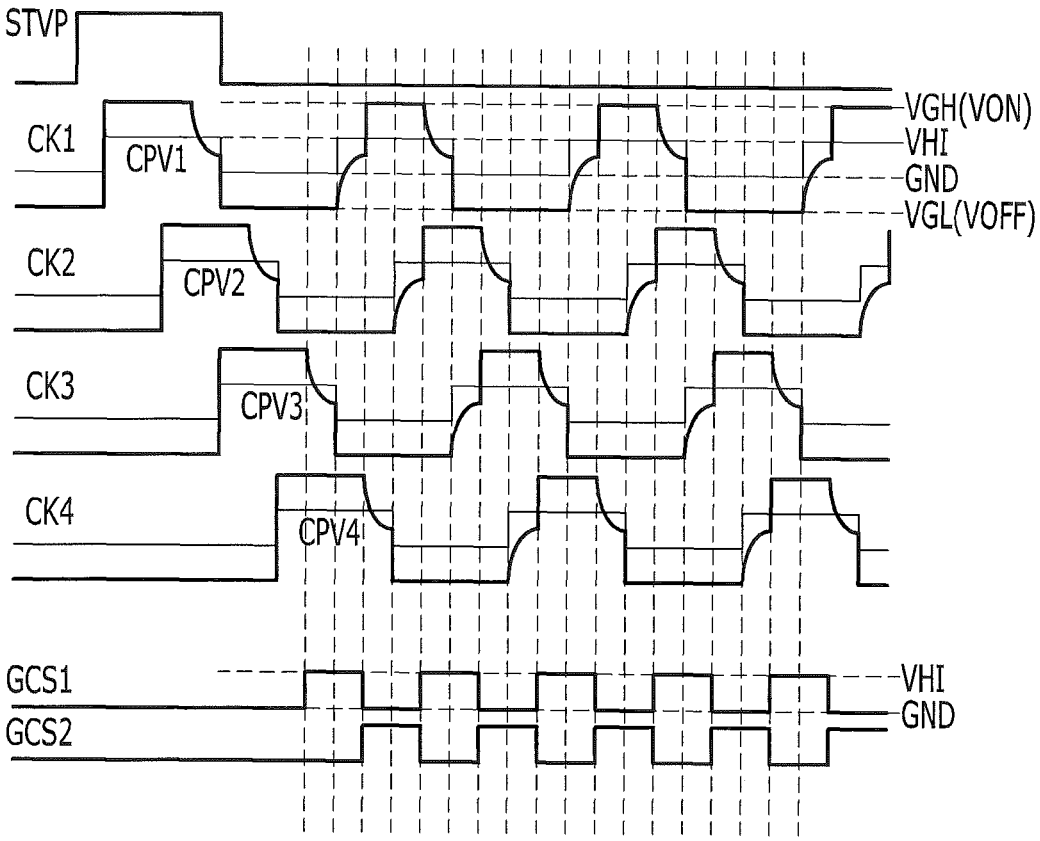
Figure 18:
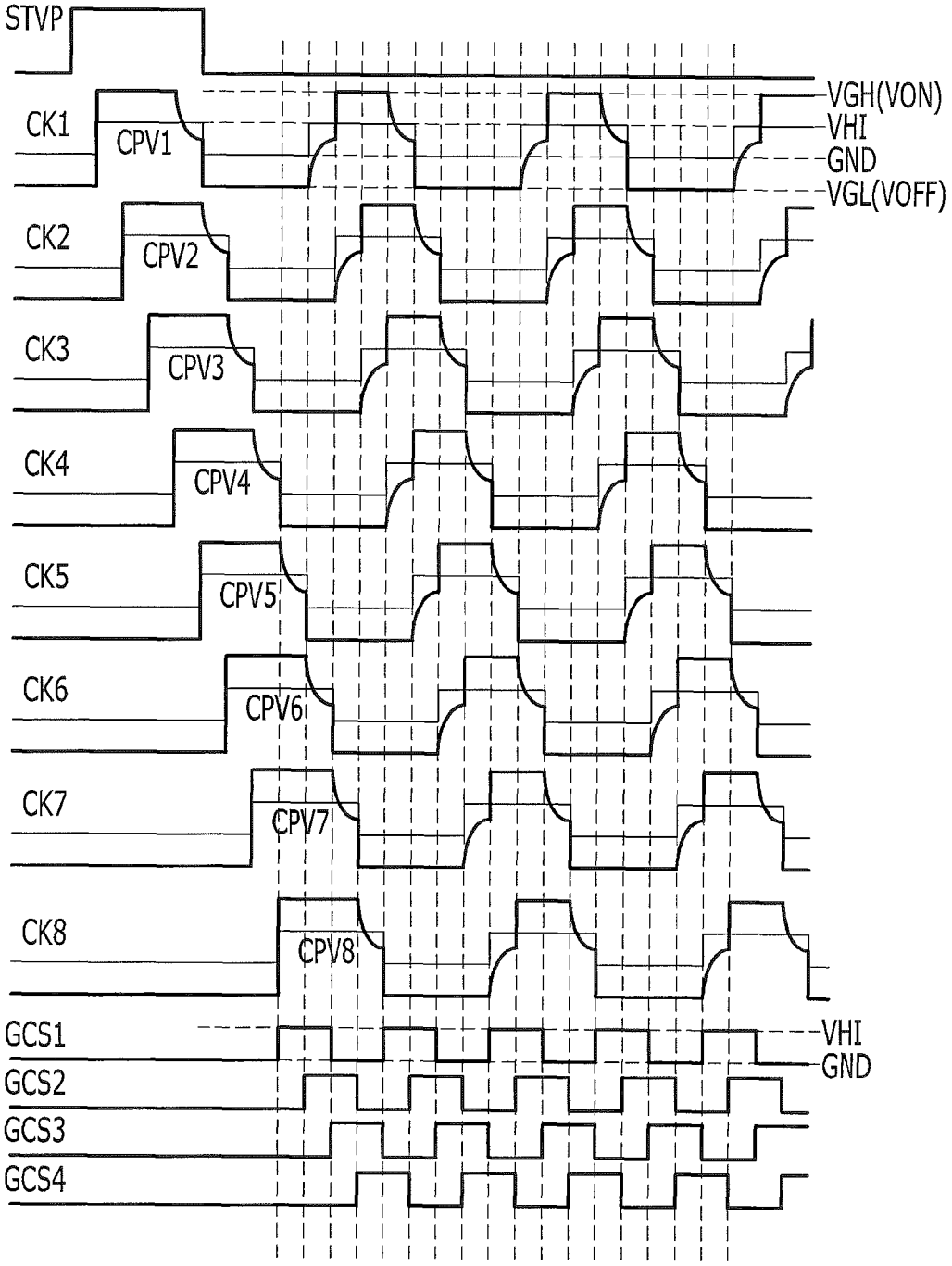

FIGS. 14 and 15 are block diagrams showing exemplary embodiments of a display devices including a driving apparatus, and FIGS. 16 to 18 are signal timing diagrams showing signals of exemplary embodiments of a display device.

An exemplary embodiment of a display device 800, as shown in FIG. 14, includes a display panel 810, a circuit board 820 and the flexible circuit film 830. The flexible circuit film 830 may be attached to the display panel 810 and the circuit board 820 to connect the display panel 810 and the circuit board 820.

The display panel 810 may include a substrate (not shown) including a transparent material such as glass. The display panel may further include a plurality of pixels PX that displays images, a plurality of gate lines GL and a plurality of data lines DL disposed on the substrate. Each of the pixels PX may include a thin film transistor Q having a gate connected to a corresponding gate line GL and a drain connected to a corresponding data line DL. The display panel 810 may be a type of flat panel display such as an LCD or an organic light emitting display device ("OLED"), for example, but not being limited thereto.

A gate driver 840 may be disposed on the display panel 810. The gate driver 840 is connected to the gate lines GL and applies gate signals to the gate lines GL. Circuit elements of the gate driver 840 may include a plurality of thin films, similarly to the thin film transistor Q, and may be provided during a process for providing the thin film transistor Q.

The circuit board 820 may include a signal controller 850 and a clock signal generator 860. In an exemplary embodiment, the signal controller 850 and the clock signal generator 860 may be implemented in different semiconductor chips to be mounted on the circuit board 820. In an alternative exemplary embodiment, both the signal controller 850 and the clock signal generator 860 may be integrated into a same single chip. The clock signal generator 860 may be substantially the same as the exemplary embodiments of the clock signal generator described above.

A data driver 870 may be implemented as a chip, for example, and mounted on the flexible circuit film 830, and the data driver 870 is connected to the data lines DL and applies data signals to the data lines DL. The data driver 870 may be controlled by the signal controller 850.

In an exemplary embodiment, the signal controller 850 generates and outputs pre-clock signals CPVs, a charge sharing control signal GCS, and a scanning start signal STV to the clock signal generator 860, and the clock signal generator 860 generates clock signals CKs based on the pre-clock signals CPVs and the charge sharing control signal GCS, and outputs the clock signals CKs to the gate driver 840. In such an embodiment, the clock signal generator 860 also transmits the scanning start signal STV to the gate driver 840.

The gate driver 840 generates gate signals based on the clock signals CKs and applies the gate signals to the gate lines GL, and the data driver 870 applies data signals to the data lines DL. The transistor Q of the pixel PX is turned on in response to a gate signal to transmit a data signal to the pixel PX, and the pixel PX displays an image based on the received data signal.

An alternative exemplary embodiment of a display device 900, as shown in FIG. 15, includes a display panel 910, and a gate driver 920 and a driving chip 930 are provided on the display panel 910.

The display panel 910 may include a substrate (not shown) including a transparent material such as glass, and a plurality of pixels (not shown) that displays images, a plurality of gate lines GLl and GLr, and a plurality of data lines (not shown) may be disposed on the substrate similarly to the exemplary embodiment shown in FIG. 14. The display panel 910 may be a type of flat panel display such as an LCD or an OLED, for example.

The gate driver 920 may include a pair of driving circuits 922 and 924 disposed on opposing sides of the display panel 910, e.g., left and right side of the display panel 910. The gate lines GLl and GLr may be alternately connected to the left driving circuit 922 and the right driving circuit 924. Circuit elements of the driving circuits 922 and 924 may include a plurality of thin films, and may be provided along with the pixel.

The driving chip 930 is disposed, e.g., mounted, on the display panel 910, and may include a signal controller (not shown), a clock signal generator (not shown) and a data driver (not shown), for example. In an exemplary embodiment, the signal controller and the clock signal generator may be integrated into the driving chip 930. The clock signal generator may be substantially the same as the exemplary embodiments of the clock single generator described above.

In an exemplary embodiment, when the gate driver 840 or 920 of the display device 800 or 900 shown in FIGS. 14 and 15 generates gate signals, the gate driver 840 or 920 may adopt one of a single driving using a pair of clock signals, a double driving using two pairs of clock signals and a quadruple driving using four pairs of clock signals, for example. FIGS. 16 to 18 show signals used for the single driving, the double driving and the quadruple driving, respectively. As shown in FIGS. 16 to 18, the number of the charge sharing control signals GCSi is half of the number of clock signals CKi, that is, one charge sharing control signal GCSi per a pair of clock signals CKi.

In the display device 900 shown in FIG. 15, since the gate signals are applied alternately to the gate lines GLl connected to the left driving circuit 922 and to the gate lines GLr connected to the right driving circuit 924, the quadruple driving may be adopted.

While this disclosure has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A driving apparatus for a display device comprising:

a signal controller that generates a pre-clock signal, a charge sharing control signal and a scanning start signal;

a clock signal generator that generates a clock signal having a value swinging between a first voltage and a second voltage based on the pre-clock signal and the charge sharing control signal; and a gate driver that generates a plurality of gate signals to be applied to a plurality of pixels of a display panel of the display device based on the scanning start signal and the clock signal, wherein the clock signal generator comprises:

a voltage generator that generates a third voltage; and a clock generator that receives one of the third voltage from the voltage generator, the first voltage and the second voltage in response to the pre-clock signal and the charge sharing control signal, and outputs an output signal through an output terminal as the clock signal, the output signal obtained based on the one of the third voltage, the first voltage and the second voltage, wherein the third voltage is higher than the first voltage and lower than the second voltage, wherein each of the pre-clock signal and the charge sharing control signal has a first value and a second value, the first value is larger than the second value, wherein the value of the clock signal is changed from the first voltage to the third voltage and then from the third voltage to the second voltage, and wherein the value of the clock signal is changed from the second voltage to the third voltage when the pre-clock signal has the first value and the charge sharing control signal changes from the second value to the first value, and then from the third voltage to the first voltage when the charge sharing control signal has the first value and the pre-clock signal changes from first value to the second value.

2. The driving apparatus of claim 1, wherein the clock generator comprises:

a first switch connected between the first voltage and the output terminal;

a second switch connected between the second voltage and the output terminal;

a third switch connected between the voltage generator and the output terminal, wherein each of the first, second and third switches is turned on and off based on the pre-clock signal and the charge sharing control signal.

3. The driving apparatus of claim 2, wherein when the pre-clock signal has the first value, the first and the third switches are turned off and the second switch is turned on regardless of a value of the charge sharing control signal, when the pre-clock signal has the second value and the charge sharing control signal has the first value, the first switch is turned on and the second and the third switches are turned off, and when both the pre-clock signal and the charge sharing control signal have the second value, the first and the second switches are turned off and the third switch is turned off.

4. The driving apparatus of claim 3, wherein the charge sharing control signal rises at a time point prior to each of a rising edge and a falling edge of the pre-clock signal, and the charge sharing control signal falls at a time point subsequent to each of a rising edge and a falling edge of the pre-clock signal.

5. The driving apparatus of claim 4, wherein the voltage generator comprises:

a plurality of input resistors connected in series, wherein the plurality of input resistors divides a voltage from a voltage source and outputs the divided voltage;

an operational amplifier including a positive terminal connected to the output of the input resistors, a negative terminal and an output terminal feedback connected to the negative terminal; and a capacitor connected to the output terminal of the operational amplifier.

6. The driving apparatus of claim 5, wherein the voltage generator further comprises:

an output resistor connected to the output terminal of the operational amplifier in parallel with the capacitor, wherein the output terminal of the clock generator is connected to the output resistor.

7. The driving apparatus of claim 4, wherein the voltage generator comprises:

a capacitor connected to a voltage source; and an output resistor connected to the voltage source and an output terminal thereof in parallel with the capacitor.

8. The driving apparatus of claim 4, wherein the voltage generator includes an output terminal connected to a ground.

9. A driving apparatus of a display device comprising:

a signal controller that generates first and second pre-clock signals, a first charge sharing control signal and a scanning start signal;

a clock signal generator that generates first and second clock signals having a value swinging between a first voltage and a second voltage based on the first and second pre-clock signals and the first charge sharing control signal; and a gate driver that generates a plurality of gate signals to be applied to a plurality of pixels of a display panel of the display device based on the scanning start signal and the first and second clock signals, wherein the clock signal generator comprises:

a voltage generator that generates a third voltage;

a first clock generator that receives one of the third voltage from the voltage generator, the first voltage and the second voltage in response to the first pre-clock signal and the first charge sharing control signal, and outputs an output signal obtained based on the one of the third voltage from the voltage generator, the first voltage and the second voltage through an output terminal thereof as the first clock signal; and a second clock generator that receives one of the third voltage form the voltage generator, the first voltage and the second voltage in response to the second pre-clock signal and the first charge sharing control signal, and outputs an output signal obtained based on the one of the third voltage form the voltage generator, the first voltage and the second voltage through an output terminal thereof as the second clock signal, wherein the second pre-clock signal is phase shifted by about 180-degree with respect to the first pre-clock signal, wherein the third voltage is higher than the first voltage and lower than the second voltage, wherein each of the pre-clock signal and the charge sharing control signal has a first value and a second value, the first value is larger than the second value, wherein the value of the clock signal is changed from the first voltage to the third voltage and then from the third voltage to the second voltage, and wherein the value of the clock signal is changed from the second voltage to the third voltage when the pre-clock signal has the first value and the charge sharing control signal changes from the second value to the first value, and then from the third voltage to the first voltage when the charge sharing control signal has the first value and the pre-clock signal changes from first value to the second value.

10. The driving apparatus of claim 9, wherein each the first and second clock generators comprises:

a first switch connected between the first voltage and the output terminal;

a second switch connected between the second voltage and the output terminal; and a third switch connected between the voltage generator and the output terminal, wherein each of the first, second and third switches are turned on and off based on the first or second pre-clock signal and the first charge sharing control signal.

11. The driving apparatus of claim 10, wherein when the first or second pre-clock signal has the first value, the first and the third switches are turned off and the second switch is turned on regardless of a value of the first charge sharing control signal, when the first or second pre-clock signal has the second value and the first charge sharing control signal has the first value, the first switch is turned on and the second and the third switches are turned off, and when both the first or second pre-clock signal and the first charge sharing control signal have the second value, the first and the second switches are turned off and the third switch is turned off.

12. The driving apparatus of claim 11, wherein the first charge sharing control signal rises at a time point prior to each of a rising edge and a falling edge of the first and second pre-clock signals, and the first charge sharing control signal falls at time point subsequent to each of a rising edge and a falling edge of the first and second pre-clock signals.

13. The driving apparatus of claim 12, wherein the voltage generator comprises:

a plurality of input resistors connected in series, wherein the plurality of input resistors divides a voltage from a voltage source and outputs the divided voltage;

an operational amplifier including a positive terminal connected to the output of the input resistors, a negative terminal and an output terminal feedback connected to the negative terminal; and a capacitor connected to the output terminal of the operational amplifier.

14. The driving apparatus of claim 13, wherein the voltage generator further comprises:

an output resistor connected to the output terminal of the operational amplifier in parallel with the capacitor, and wherein the output terminal of each of the first and second clock generators is connected to the output resistor.

15. The driving apparatus of claim 12, wherein the voltage generator comprises:

a capacitor connected to a voltage source; and an output resistor connected to the voltage source and an output terminal in parallel with the capacitor.

16. The driving apparatus of claim 12, wherein the voltage generator includes an output terminal connected to a ground.

17. The driving apparatus of claim 9, wherein the gate driver is disposed on the display panel and comprises a plurality of thin films.

18. The driving apparatus of claim 17, wherein the signal controller and the clock signal generator are disposed in an outside of the display panel.

19. The driving apparatus of claim 18, wherein the signal controller and the clock signal generator are implemented in a chip disposed on the display panel.

20. The driving apparatus of claim 9, wherein the signal controller further generates at least one additional pair of pre-clock signals and at least one additional charge sharing control signal, the clock signal generator further comprises at least one additional pair of clock generators, each of the at least one additional pair of clock generators generates one of at least one additional pair of clock signals based on one of the at least one additional pair of pre-clock signals and the at least one additional charge sharing control signal, each of the at least one additional pair of clock signals has a value swinging between the first voltage and the second voltage, the value of each of the at least one additional pair of clock signals is changed from the first voltage to the third voltage and then from the third voltage to the second voltage, and the value of each of the at least one additional pair of clock signals is changed from the second voltage to the third voltage and then from the third voltage to the first voltage, and the gate driver generates the gate signals based on the at least one additional pair of clock signals.

* * * * *